US005129205A

United States Patent [19]

Rasmussen

[11] Patent-Number: 5,129,205

[45] Date of Patent: Jul. 14, 1992

[54] AUTOMATIC ADJUSTMENT DEVICE FOR A COIN WRAPPING MECHANISM

[75] Inventor: James M. Rasmussen, Chicago, Ill.

[73] Assignee: Cummins-Allison Corp., Mt. Prospect, Ill.

[21] Appl. No.: 452,181

[22] Filed: Dec. 18, 1989

[51] Int. Cl.[5] ..... B65B 11/04

[52] U.S. Cl. ..... 53/52; 53/212

[58] Field of Search ..... 53/465, 212, 213, 465, 53/52; 453/31; 493/479

[56] References Cited

U.S. PATENT DOCUMENTS 3,530,835 11/1967 Becker ..... 53/212 X 3,938,303 2/1976 Ushio ..... 53/212

4,052,839 10/1977 Gross ..... 53/212

4,674,260 6/1987 Rasmussen et al. ..... 53/212

4,832,655 5/1989 Sakurai ..... 453/31

*Primary Examiner*—John Sipos

*Attorney, Agent, or Firm*—Arnold, White & Durkee

[57] ABSTRACT

A device is provided for adjusting wrapping rollers of a coin wrapping machine so that a coin stacks of different denominations can be wrapped. The device automatically adjusts the wrapping rollers to any one of a large number of possible positions, and, therefore, allows the coin wrapping machine to wrap virtually any type of coin stack.

20 Claims, 3 Drawing Sheets

AUTOMATIC ADJUSTMENT DEVICE FOR A COIN WRAPPING MECHANISM

BACKGROUND OF THE INVENTION

1. Field of the Invention

The present invention relates generally to coin wrapping mechanisms for forming coin rolls, and more particularly to a device which automatically adjusts a coin wrapping mechanism to accept coins of different sizes.

2. Description of the Related Art

Coin wrapping machines automate the process of forming loose coins into wrapped rolls of coins. Coin wrapping machines typically include two or more rollers that hold a stack of coins in position to be wrapped. While the rollers hold the stack of coins in the proper position, a wrapping medium, such as adhesively backed paper or plastic, is wrapped about the coin roll. Typically, the rollers of coin wrapping machines are adjustable to allow coins of different sizes to be effectively wrapped.

In coin wrapping machines of this type, it is often desirable to automatically adjust the wrapping rollers. Several commercially available coin wrapping machines include this type of automatic adjustment feature However, the automatic adjustment mechanisms of these coin wrapping machines only offer a finite number of adjustable positions. These adjustable positions typically equate to prescribed settings which allow the coin wrapping machine to accept only a particular country's coinage. This limited adjustment capability is a disadvantage because coins or tokens which are different in size from these particular denominations cannot be wrapped by the coin wrapping machine.

SUMMARY OF THE INVENTION

In accordance with one aspect of the present invention, there is provided an apparatus for adjusting wrapping rollers of a coin wrapping mechanism to any one of an infinite number of positions between a maximum limit and a minimum limit. A means controllably moves the wrapping rollers to any one of the infinite number of positions between the maximum limit and the minimum limit. Preferably, the means includes an electronic control that controls the adjustment of the wrapping rollers by monitoring the position of the wrapping rollers. In response to receiving a signal to adjust the wrapping rollers, the electronic control adjusts the wrapping rollers from a first position to a second position.

In another aspect of the present invention, there is provided an apparatus for adjusting a coin wrapping mechanism to wrap coin stacks of varying denominations. The coin wrapping mechanism has at least two wrapping rollers. Two opposed adjustment members that are operably connected to the wrapping rollers are adapted to adjust the wrapping rollers by moving relative to one another. The adjusting apparatus includes an elliptical cam that is disposed between the adjustment members, and means for biasing the adjustment members into contact with the elliptical cam. A means controllably rotates the elliptical cam relative to the adjustment members, and positions the elliptical cam at a preselected position. The preselected position allows the coin wrapping mechanism to wrap a coin stack of a preselected denomination.

Preferably, the rotating means includes a motor that operably connected to the elliptical cam. An encoder is operably connected to the motor, and the encoder delivers a signal correlative to a predetermined amount of rotation provided by the motor. A control means receives the delivered signals, controllably rotates the motor, and stops rotation of the motor in response to receiving a predetermined number of the delivered signals.

BRIEF DESCRIPTION OF THE DRAWINGS

Other advantages of the invention will become apparent upon reading the following detailed description and upon reference to the drawings in which.

Figure 1:
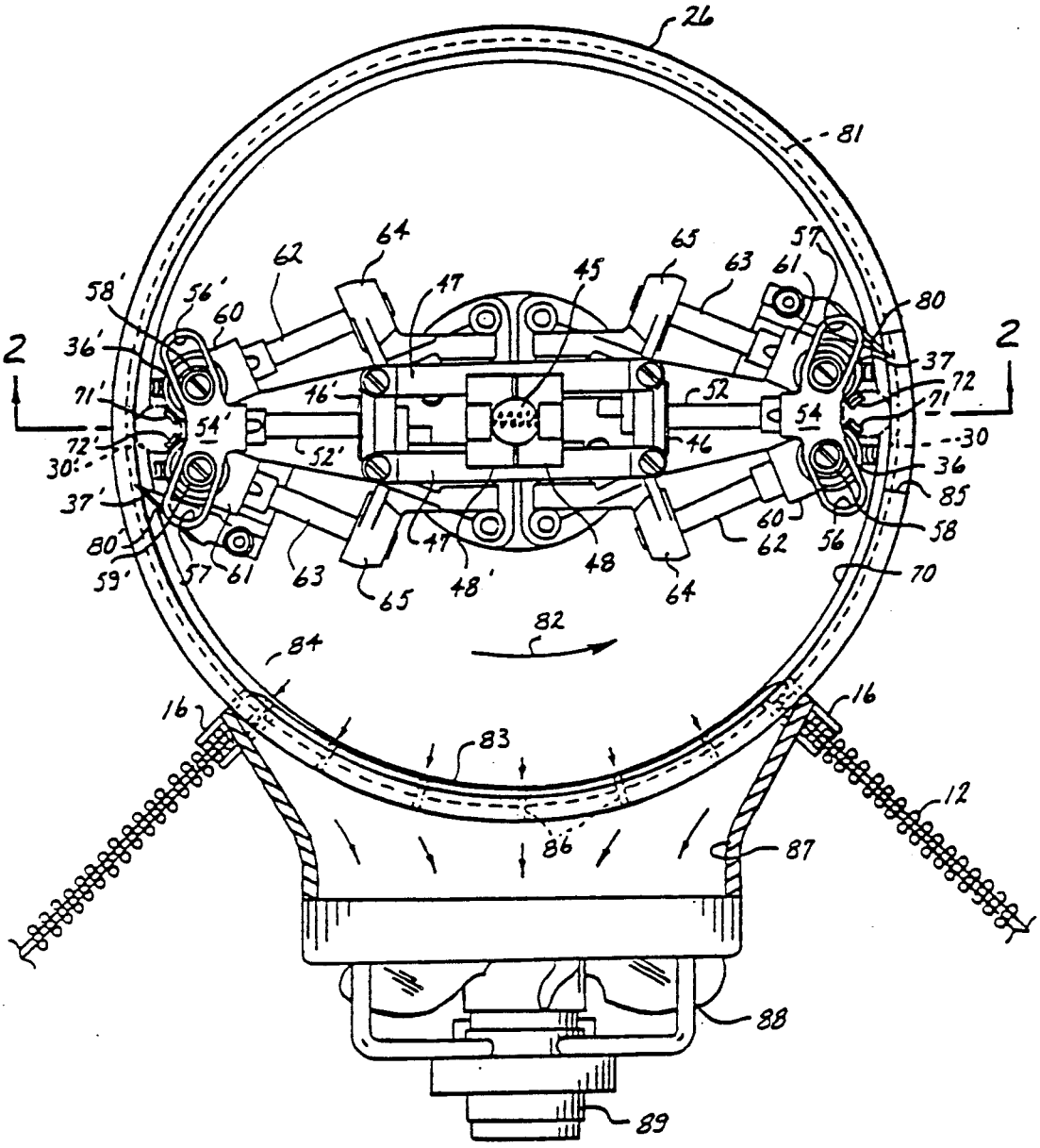
FIG. 1 illustrates a top view of a coin wrapping mechanism preferred for use with the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

U.S. Pat. No. 4,674,260 discloses a coin wrapping mechanism. The coin wrapping mechanism is "universally" adjustable because it includes an adjustment mechanism that is capable of adjusting the wrapping roller to an infinite number of positions between an upper limit and a lower limit. Therefore, the mechanism can wrap any size coin as long as its size is between the upper limit and the lower limit. However, this coin wrapping mechanism is not automatically adjustable. Instead, a coin representative of a coin in a stack of coins to be wrapped is placed between two adjustment members to correctly adjust the wrapping rollers.

For purposes of illustration, the automatic adjustment device of the present invention is described for use with the coin wrapping mechanism disclosed in U.S. Pat. No. 4,674,260 which is hereby incorporated by reference. It should be understood that this is a preferred embodiment of the present invention, and that it may take various other forms as needed to be adapted to other types of coin wrapping mechanisms.

Figure 2:
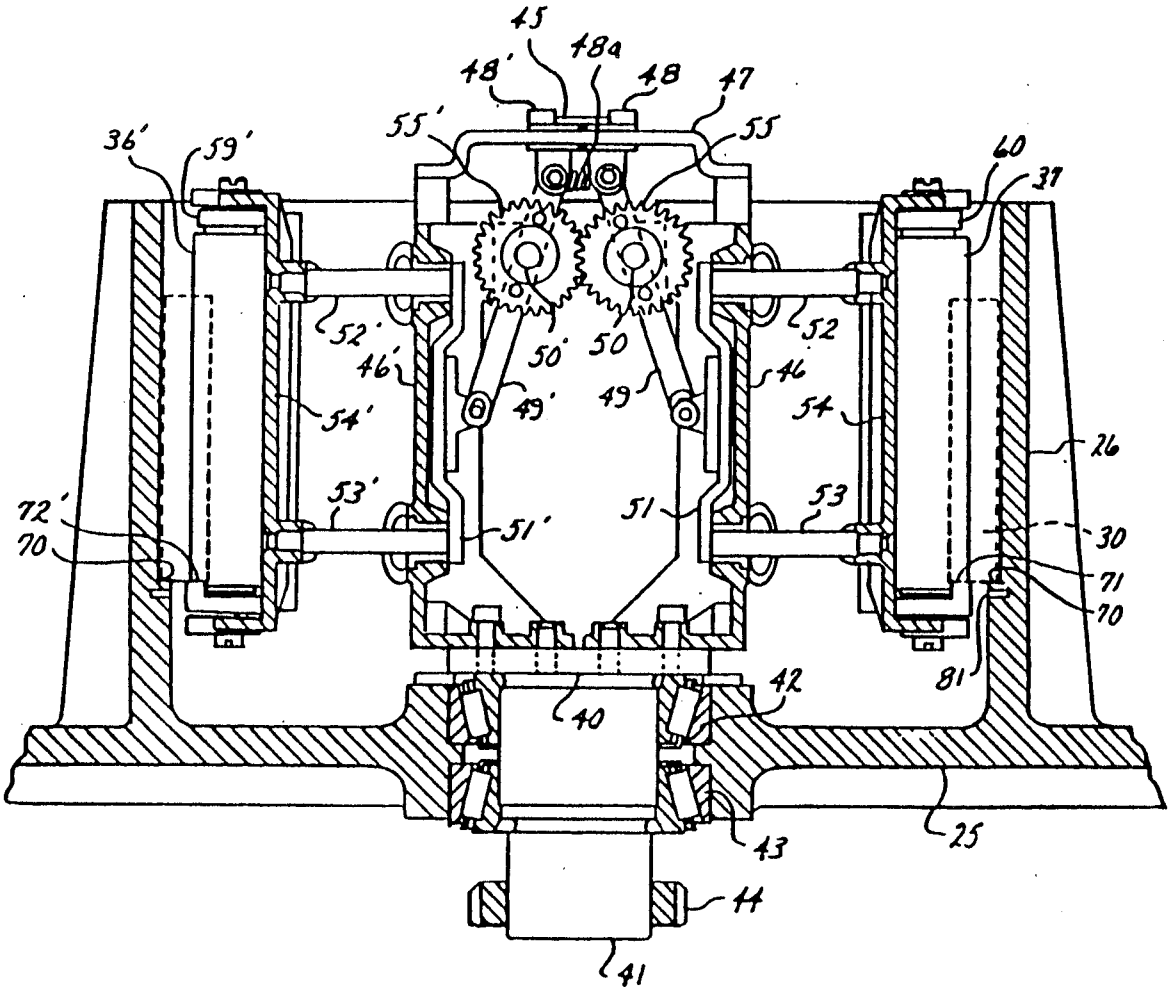
FIG. 2 is a cross-sectional view taken along line 2—2 in FIG. 1.

Turning now to the drawings, FIGS. 1 and 2 illustrate detailed elements of the preferred coin wrapping mechanism. The coin wrapping mechanism includes a cylindrical chamber 26 which surrounds a rotatable portion 28 of the mechanism. The entire rotatable portion 28 of the wrapping mechanism is supported on a flange 40 on the end of a driven spindle 41 mounted for rotation in two sets of roller bearings 42 and 43 in the base plate 25 of the wrapping chamber 26. The lower end of the spindle 41 carries a gear 44 which is connected to a suitable drive means (e.g., a stepper motor) for rotating the spindle 41 in increments of 180 degrees.

As the spindle 41 and the base plate 45 are rotated, they carry with them a central frame formed by a pair of columns 46 and 46' which are rigidly fastened to the base plate 25 by machine screws. The upper ends of the columns 46 and 46' are connected by a crown 47 which also serves as a track for a pair of adjustment members 48 and 48' which are biased toward each other by a spring 48A. The tops of the adjustment members 48, 48' form a pair of adjustment lugs between which an elliptical cam 100 is inserted to space the members 48, 48' apart by a distance proportional to the diameter of the coins in a stack of coins to be wrapped. Thus, the members 48 and 48' are spaced apart along the track formed by the crown 47 by a maximum amount when spaced apart along the major axis 102 of the elliptical cam 100, and by a minimum amount when spaced apart by the minor axis 104 of the elliptical cam 100. (see FIG. 4.) The precise function of the elliptical cam 100 will be fully explained in reference to FIGS. 3 and 4.

Each time the spacing of the adjustment members 48 and 48' is adjusted, the radial positions of the two pairs of wrapping rollers 36, 37 and 36', 37' are automatically adjusted by a mechanism comprising a pair of control arms 49 and 49' mounted for pivotal movement about fixed shafts 50 and 50'; a pair of yokes 51 and 51' connecting the lower ends of the respective control arms 50 and 50' to the ends of respective pairs of sliding rods 52, 52' and 53, 53'; and a pair of brackets 54 and 54' fastened to the outer ends of the rods 52, 52' and 53, 53' for positioning the wrapping rollers 36, 37, and 36', 37'.

To interconnect the two halves of the adjustment mechanism connected to the two adjustment members 48 and 48', the shafts 50 and 50' carry two pairs of meshing gears 55 and 55'. Because of this gear connection, movement of either of the adjustment members 48 and 48' along the crown 47 results in a corresponding movement of the other adjustment member, thereby ensuring that the two halves of the adjustment mechanism are moved in synchronism with each other and by precisely the same amounts.

In order to properly position the wrapped rollers 36, 37 and 36', 37' in response to adjusting movement of the rods 52, 53 and 52', 53', the upper and lower ends of the brackets 54 and 54' form camming slots 56, 57 and 56', 57' (see FIG. 1). These camming slots receive cam followers 58, 59 and 58', 59' on the shafts of the respective wrapping rollers 36, 37 and 36', 37', so that the wrapping rollers are cammed to different positions determined by the shape of the camming slots 56, 57 and 56', 57' whenever the rods 52, 53 and 52', 53' are adjusted. Since the adjusting movement of the rods 52, 53 and 52', 53' is determined by the length between diametrically opposed edges of the elliptical cam 100 which is inserted between the two adjustment member 48 and 48', the camming slots 56, 57 and 56', 57' are designed to move the wrapping rollers to precisely the desired position for each different coin denomination. That is, the diameter of a circle touching the surfaces of the two rollers 36 and 37 and the inner wall of the cylinder called chamber 26 (see broken-line circles 30 and 30' in FIG. 1) should be just slightly larger than the diameter of the particular coin denomination to be wrapped.

To support the wrapping rollers in fixed vertical positions, each wrapping roller 36 or 37 is mounted on its own bracket 60 or 61, respectively. The shafts of the wrapping rollers extend through the horizontal arms of these brackets 60 and 61, and the brackets in turn are fastened to upper and lower pairs of guide rods 62 and 63 extending inwardly there from through corresponding bosses 64 and 65 on the corners of the support column 46. The rod 62 and 63 are slidably supported within the bosses 64 and 65 to permit the wrapping rollers 36 and 37 to move back and forth along the axis' of these rods in response to the camming action described above. Of course, the other pair of wrapping rollers 36' and 37' are equipped with similar brackets 60' and 61' fastened to guide rods 62' and 63' extending through bosses 64' and 65'.

When the control arms 49, 49' are pivoted in response to rotation of the elliptical cam 100 between the two adjustment members 48, 48', the radial positions of the wrapping rollers 36, 37 and 36', 37' are automatically adjusted to accommodate stacks of coins of a predetermined denomination. The adjustability of this mechanism is universal in the sense that it can be stopped anywhere between its end limits, so that it can accommodate any number of different coins or tokens. This permits the same mechanism to be used for coins of different countries, for example. The space between the wrap rollers is set to accept a stack of coins by allowing a clearance around the stack of coins. This clearance allows for a variance in the coin diameter, maintains a uniform stack, and allows for a wrapping medium to be wrapped about the stack.

After the wrapping rollers 36, 37 and 36', 37' have been positioned to receive stacks of coins of the desired denomination, a stack of such coins is lowered into the cylindrical chamber 36. The stack of coins is supported between a set of three supports 70, 71 and 72 which engage the bottom of the coin stack 38 throughout the wrapping operation and permit the coin stack 30 to be rotated as it is rolled about the inner surface of the cylindrical chamber A driven sprocket belt 12, which is disposed about sprocket wheels 16, engages with an adhesively backed paper web 10 and pulls the paper web 10 upwardly through a slot (not shown) and onto the inner wall of the cylindrical chamber 26 that is lined with a resilient pad 83. To ensure that the paper remains against the pad 83, a light vacuum is preferably applied to the paper surface which faces the inner wall. As illustrated in FIG. 1, both the pad 83 and the corresponding portion of the inner wall are perforated by apertures 86 with the radially outer ends of the apertures 86 opening into a manifold 87 that leads to a suction fan 88. A motor 89 drives the fan 88 to exhaust air from the manifold 87 and thereby draws the paper web 10 firmly against the pad 83.

To effect the wrapping of a coin stack 30 after it has be deposited on the supports 70, 71, 72, the spindle 41 is rotated in a direction indicated by the arrow 82 in FIG. 1. This moves the wrapping rollers 36, 37 in the same direction, carrying the coin stack 30 with them along the inner surface of the cylindrical chamber 26 and across the adhesively coated surface of the paper web 10. The resilient pad 83 ensures that the paper web 10 is pressed into firm engagement with the coin stack 30. The leading edge 84 of the pad 83 is beveled so that the coin stack 30 rolls smoothly across the edge of the pad 83 and onto the paper web 10, thereby compressing the pad 83 so that the pad 83 applies biasing pressure on the paper web 10 to urge it against the coin stack 30. The pad 83 extends along the full circumferential length of the paper web 10, so that the biasing pressure is applied throughout the wrapping of the coin stack 30.

After the coin stack 30 has been rolled across the entire circumferential length of the paper web 10 by the orbiting movement of the wrapping rollers 36, 37, the spindle 41 continues to move the rollers to a position diametrically opposed to the position where the coin stack 30 was initially loaded. This 180 degree movement of the wrapping rollers 36, 37 brings the wrapped roll of coins into register with an aperture 85 in the wall of the cylindrical wall of the chamber 26 through which the wrapped coin roll 30 can be discharged from the cylindrical chamber 26.

Figure 4:
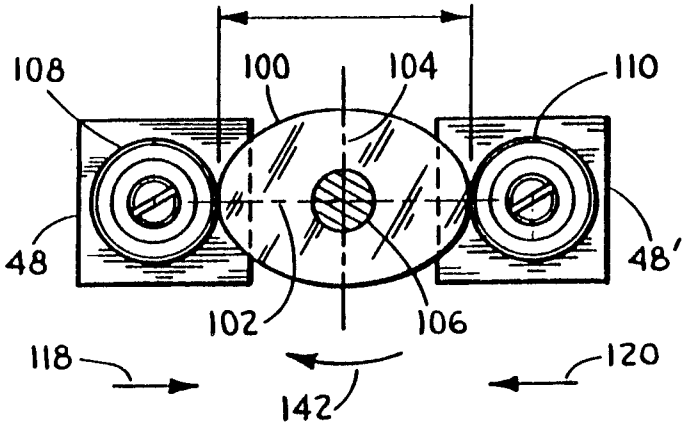
FIG. 4 is a cross-sectional view taken along line 4—4 in FIG. 3.
Figure 5:
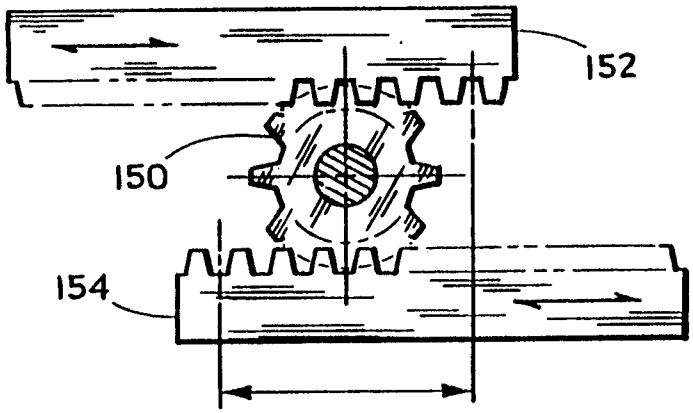
FIG. 5 illustrates an alternate embodiment of the automatic adjustment device in accordance with the present invention.
Figure 3:
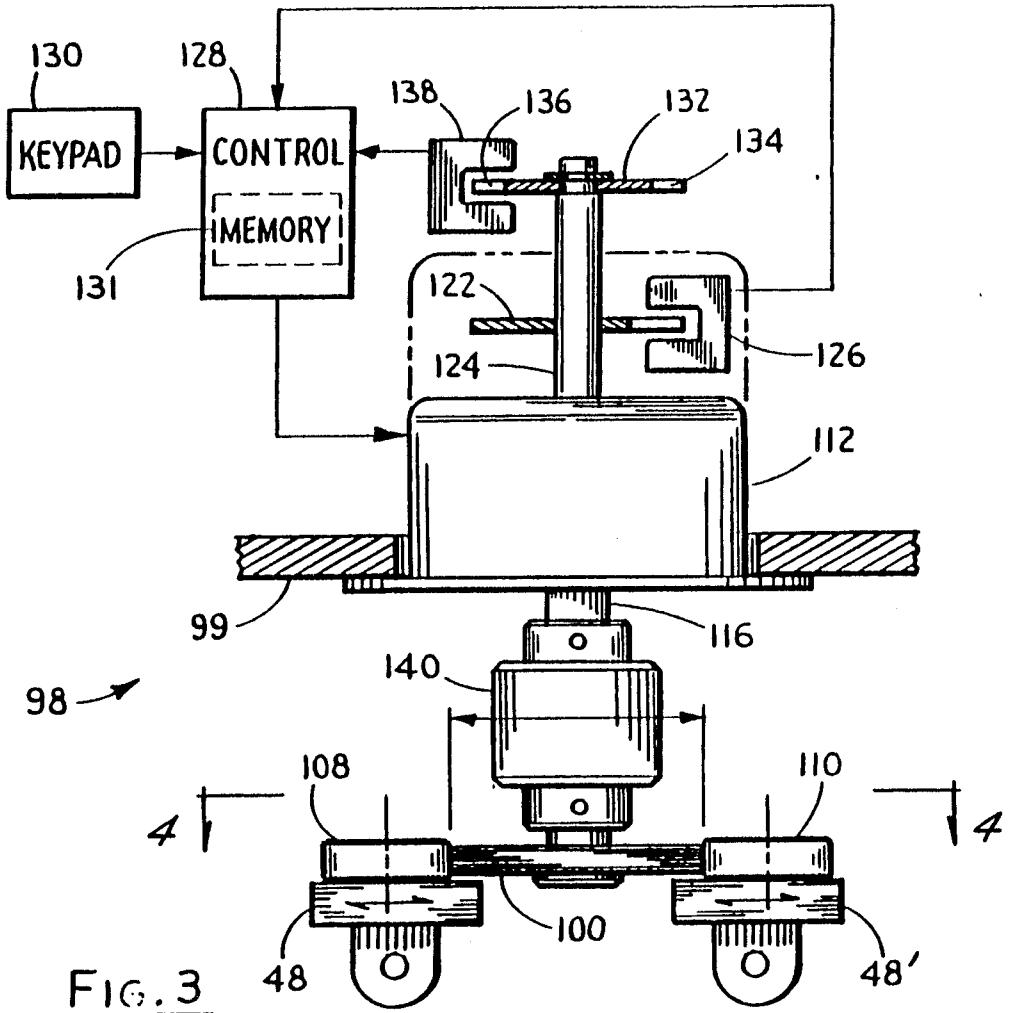
FIG. 3 illustrates a side view of an automatic adjustment device in accordance with the present invention.

Referring now to FIGS. 3 and 4, there is illustrated a preferred embodiment of an automatic adjustment device 98 for use with the coin wrapping mechanism. Preferably, the automatic adjustment device 98 is mounted above at least a portion of the rotatable portion 28 by a fixed housing 99. As previously stated, the elliptical cam 100 of the automatic adjustment device 98 is disposed between the adjustment members 48 and 48'.

The elliptical cam 100 is defined by a major axis 102 and a minor axis 104 which are perpendicular to one another and which intersect at the center of rotation 106 of the elliptical cam 100. The center of rotation 106 is axially aligned with the center of rotation of the rotatable portion 28 of the wrapping mechanism and with the mid-point between the sliding adjustment members 48 and 48'. The length of the major axis 102 represents the maximum adjustment limit of the elliptical cam 100, and the length of the minor axis 104 represents the minimum adjustment limit of the elliptical cam 100. Preferably, the length of the major axis is 1.500 inches and the length of the minor axis is 0.500, inches. Rotation of the cam 100 controllably moves the adjustment members 48, 48', and, thus, the wrapping rollers 36, 37, to any one of the infinite positions between the maximum and minimum limits.

The elliptical cam 100 is adapted to rotate with respect to the adjustment members 48 and 48'. Preferably, a roller cam follower 108, 110 is connected to each respective adjustment member 48, 48', respectively. The addition of the roller cam followers 108, 110 reduces the friction and wear of the edge of the elliptical cam 100 when the cam 100 is rotated.

The center 106 of the elliptical cam 100 is operably connected to a motor 112. The motor 112 is adapted to rotate the cam 100 in at least one direction with respect to the adjustment members 48 and 48'. The motor 112 outputs rotational motion via a lower output shaft 116 which is operably connected to the center of rotation 106 of the elliptical cam 100. As the motor 112 rotates the cam 100, the distance between the adjustment members 48 and 48' changes in response to the changing distance between the diametrically opposed edges of the elliptical cam 100 that contact the cam followers 108 and 110. Preferably, the cam followers 108 and 110 are inwardly biased toward one another in the direction of arrows 118 and 120 in order to maintain contact between the diametrically opposed edges of the elliptical cam 100 and the cam followers 108 and 110.

The motor 112 includes means for monitoring its rotation, such as an encoder assembly 114. As the motor 112 rotates, an encoder disc 122 in the encoder assembly 114 rotates on an upper output shaft 124 of the motor 112. The encoder disc 122 includes a multitude of slots (not shown) about its outer periphery. Preferably, the encoder disc 122 includes about 4000 slots about its periphery. A sensor 126 is disposed proximate the outer periphery of the encoder disc 122, and generates pulses as the slots in the outer periphery of the encoder disc 122 pass through the sensor 126. Preferably, the upper output shaft 124 also carries a home position disc 132 which includes two diametrically opposed slots 134 and 136 in its outer periphery. A sensor 138 is disposed proximate the outer periphery of the home position disc 132, and generates a pulse each time one of the slots 134, 136 is rotated through the sensor 138. The slots 134 and 136 are related to a specific position of the elliptical cam 100. As shown, the diametrically opposed slots 134 and 136 indicate that the elliptical cam 100 is positioned with its major axis 102 separating the adjustment members 48 and 48'.

An electronic control 128 receives signals from the sensors 126 and 138. The pulses delivered by the sensors 126 and 138 are interpreted by the control 128, and equated to distinct positions of the elliptical cam 100. By equating the number and timing of pulses to a given adjustment, the control 128 can activate the motor 112 to selectively rotate the elliptical cam 100 to a predetermined position so that a coin having a preselected diameter between the lower and upper limits may be effectively wrapped in the wrapping mechanism. This is extremely useful if it is desirable to use the coin wrapping mechanism to wrap a previously unknown coin or token.

Preferably, the diameter of an unknown coin or token is entered into the electronic control 128 via a keypad 130. The control 128 receives the diameter input from the keypad 130, and calculates the required clearances of the wrapping rollers 36, 37 for a coin of that diameter. Alternatively, since the control 128 preferably includes read-only-memory 131, the control 128 selects an appropriate clearance from a table or curve stored in the memory. The control 128 then signals the motor 112 to rotate by a predetermined amount to accurately position the elliptical cam 100 so that the wrapping rollers 36 and 37 are adjusted to properly accept a stack of coins of the particular diameter. A particular known type of coin may also be entered on the keypad 130. In this case, the memory 131 stores a predetermined clearance for that coin and the amount that the motor 112 should be turned in order to properly position the elliptical cam 100, and, thus, the wrapping rollers 36 and 37. Advantageously, the read-only-memory is replaceable, to that one memory could be used to store the appropriate settings for coins of one country, and another memory could be used to store the appropriate settings for coins of a different country.

Rotation of the motor 112 by 90 degrees adjusts the wrapping rollers 36 and 37 from their upper limit to their lower limit. Each time a different coin denomination is to be wrapped, the proper code is entered on the keypad 130 and the proper position of the motor is determined by the control 128. The control 128 signals the motor 112 to rotate until a signal is received from the sensor 138, which indicates that the elliptical cam 100 is in a known position. The control 128 then signals the motor 112 to rotate by a predetermined amount which is accurately controlled via the feedback provided by the encoding disc 122 and associated sensor 126.

Assume that the encoding disc 122 contains 4000 slots about its periphery, that the length of the major axis 102 is 1.500 inches, and that the length of the minor axis 104 is 0.500 inches. In 90 degrees of rotation between the major axis 102 and the minor axis 104, 1000 slots pass through the sensor 126 and the distance between the adjustment members 48, 48' changes by an inch in increments of 0.001 inches. Therefore, the elliptical cam 100 can be positioned at any one of 1000 positions. Encoder discs having more slots will provide greater resolution, better accuracy, and more possible positions.

The coin wrapping mechanism in the preferred embodiment rotates in order to wrap a stack of coins. As the rotatable portion of the coin wrapping mechanism rotates, it is important that the elliptical cam 100 remain stationary with respect to the adjustment members 48 and 48' in order to maintain the proper position of the wrapping rollers 36 and 37. For this reason, a clutch 140 is positioned between the lower output shaft 116 of the motor 112 and the elliptical cam 100. The clutch 140 allows the motor 112 to rotate the cam 100 with respect to the adjustment members in only one direction. If the motor 112 rotates in the opposite direction, the clutch 140 does not transfer the rotational motion to the elliptical cam 100. Therefore, the cam 100 is allowed to freely rotate in the opposite direction.

As shown by arrow 82 in FIG. 1, the rotatable portion 28 of the coin handling mechanism rotates in the counter-clockwise direction. The motor 112 rotates the cam 100 in a clockwise direction, as illustrated by arrow 142, to adjust the positions of the rollers 36, 37. Therefore, the elliptical cam 100 rotates with the rotatable portion 28 in the counter-clockwise direction, and rotates with respect to the adjustment members in the clockwise direction. The spring 48A provides sufficient force in the direction of arrows 118 and 120 to maintain the elliptical cam 100 in its prescribed position between the roller followers 108 and 110 as the rotatable portion 28 of the coin handling mechanism is rotated. With this arrangement, a direct connection between the automatic adjustment device and the coin handling mechanism is maintained while independent rotation is allowed. Of course, if the coin handling mechanism is of a type which does not require rotation in order to wrap a stack of coins, the clutch 140 would not be used.

Furthermore, if it is desired or required to eliminate the biasing force of the spring 48A, the elliptical cam 100 may be replaced by a gear pinion 150, and the cam followers 108, 110 can be replaced by racks 152 and 154 which are mounted to portions of the mechanism which provide the adjustment. For instance, rack 152 would be attached to adjustment member 48, and rack 154 would be attached to adjustment member 48'In order to move the adjustment members 48, 48'apart, the gear pinion 150 would be rotated in a counter-clockwise direction. Similarly, in order to move the adjustment members 48, 48' together, the gear pinion 150 would be rotated in a clockwise direction. In this example, the motor 112 would be a reversible motor which provides rotation in both the counter-clockwise and clockwise directions, while in the previous example, the motor 112 was only rotated in a single direction (clockwise).

I claim:

1. In an apparatus for adjusting wrapping rollers of a coin wrapping mechanism, said wrapping rollers being positionable in any one of an infinite number of positions between a maximum limit and a minimum limit, said improvement comprising:

a cam for controllably moving said wrapping rollers to any one of said infinite number of positions between said maximum limit, and said minimum limit, a controllable drive motor connected to said cam for rotating the cam to angular positions corresponding to said infinite number of positions of said wrapping rollers, manually operated input means for producing an electrical signal representing the denomination of the coins to be wrapped, and control means responsive to said electrical signal for energizing said drive motor to rotate said cam to an angular position corresponding to the denomination of the coins to be wrapped, and then de-energizing said drive motor to stop said cam at said angular position, thereby positioning said wrapping rollers at the position required for the denomination of coins to be wrapped.

2. The apparatus, as set forth in claim 1, wherein said moving means determines said maximum limit and said minimum limit.

3. The apparatus, as set forth in claim 1, wherein said moving means comprises an electronic control that controls the adjustment of said wrapping rollers.

4. The apparatus, as set forth in claim 3, wherein said electronic control monitors the position of said wrapping rollers.

5. The apparatus, as set forth in claim 4, wherein said electronic control adjusts said wrapping rollers from a first position to a second position in response to receiving an appropriate signal.

6. An apparatus for adjusting wrapping rollers of a coin wrapping mechanism to wrap coin stacks of differing denominations, said coin wrapping mechanism having at least one adjustment member, said apparatus comprising:

a cam having an elliptical peripheral shape, said periphery being disposed in engagement with said adjustment member;

means for rotating said cam, rotation of said cam moving said adjustment member and said wrapping rollers through an infinite number of positions between a maximum limit and a minimum limit, said maximum limit being correlative to the major axis of said elliptical cam and said minimum limit being correlative to the minor axis of said elliptical cam; and means for halting rotation of said cam at any one of a predetermined number of said infinite number of positions.

7. The apparatus, as set forth in claim 6, wherein said rotating means comprises:

a motor being operably connected to said cam, said motor being adapted to rotate said cam relative to said adjustment member.

8. The apparatus, as set forth in claim 7, wherein said halting means comprises:

means for determining the position of said cam relative to said adjustment member; and means for controllably rotating said motor to rotate said cam to a selected one of said predetermined number of positions.

9. The apparatus, as set forth in claim 6, wherein said predetermined number of positions is at least 500.

10. An apparatus for adjusting a coin wrapping mechanism to wrap coin stacks of varying denominations, said coin wrapping mechanism having at least two wrapping rollers, and having opposed adjustment members being operably connected to said wrapping rollers and being adapted to adjust said wrapping rollers by moving relative to one another, said apparatus comprising:

an elliptical cam disposed between said adjustment members for controllably moving said adjustment means to anyone of an infinite number of positions between a maximum limit and a minimum limit;

means for biasing said adjustment members into contact with said elliptical cam;

means for controllably rotating said elliptical cam relative to said adjustment members, and positioning said elliptical cam at a preselected position, said preselected position allowing said coin wrapping mechanism to wrap a coin stack of a preselected denomination.

11. The apparatus, as set forth in claim 10, wherein said rotating means comprises:

a motor being operably connected to said elliptical cam, said motor being adapted to rotate said elliptical cam relative to said adjustment members.

12. The apparatus, as set forth in claim 11, wherein said rotating means further comprises:

means for delivering an activating signal to said motor in response to an adjustment signal, and for delivering a deactivating signal to said motor in response to said elliptical cam reaching said preselected position.

13. The apparatus, as set forth in claim 12, wherein said rotating means further comprises:

an encoder being operably connected to said motor, said encoder delivering a signal correlative to a predetermined amount of rotation provided by said motor; and control means for receiving said delivered signals, controllably rotating said motor, and stopping rotation of said motor in response to receiving a predetermined number of said delivered signals.

14. The apparatus, as set forth in claim 10, wherein said means for biasing comprises a spring being connected between said adjustment members.

15. An apparatus for adjusting a coin wrapping mechanism to wrap coin stacks of varying denominations, said coin wrapping mechanism having a rotatable portion, said rotatable portion having at least two wrapping rollers, and having opposed adjustment members being operably connected to said wrapping rollers and which are adapted to adjust said wrapping rollers by moving relative to one another, said apparatus comprising:

an elliptical cam disposed between said adjustment members for controllably moving said adjustment members to anyone of an infinite number of positions between a maximum limit and a minimum limit;

means for biasing said adjustment members into contact with said elliptical cam;

means for controllably rotating said elliptical cam relative to said adjustment members, and positioning said elliptical cam at a preselected position, said preselected position allowing said coin wrapping mechanism to wrap a coin stack of a preselected denomination; and means for allowing said elliptical cam to rotate with said rotatable portion of said coin wrapping mechanism.

16. The apparatus, as set forth in claim 15, wherein said means for biasing comprises a spring being connected between said adjustment members.

17. The apparatus, as set forth in claim 15, wherein said rotating means comprises:

a motor being operably connected to said elliptical cam, said motor being adapted to rotate said elliptical cam relative to said adjustment members.

18. The apparatus, as set forth in claim 17, wherein said rotating means further comprises:

an encoder being operably connected to said motor, said encoder delivering a first signal correlative to a predetermined amount of rotation provided by said motor, and delivering a second signal correlative to a predetermined position of said cam; and control means for receiving said delivered signals, counting said first signal after receiving a second signal, and stopping rotation of said motor in response to counting a predetermined number of said first signals.

19. The apparatus, as set forth in claim 15, wherein said allowing means comprises:

a clutch connected between said rotating means and said elliptical cam, said clutch allowing said rotating means to rotate said elliptical cam in a first direction relative to said adjustment members, and said clutch allowing said elliptical cam to rotate with said adjustment members in a second direction.

20. In an apparatus for adjusting wrapping rollers of a coin wrapping mechanism having a pair of wrapping rollers spaced from a substrate from capturing a stack of coins between said rollers and said substrate, means for moving said pair of wrapping rollers across the surface of said substrate so as to roll the coin stack along the surface of an adhesive-coated wrapping material on said substrate, the improvement comprising a cam for controllably moving said wrapping rollers to any one of an infinite number of positions relative to said substrate, and a clutch connected between said motor and said cam to enable said motor to rotate said cam in only one direction, and to permit said cam to be moved along with said pair of wrapping rollers while said drive motor remains stationary.

* * * * *